US005337504A

United States Patent [19]

Krumm

[11] Patent Number: 5,337,504

[45] Date of Patent: Aug. 16, 1994

[54] GUN TUBE

[75] Inventor: Herbert Krumm, Kaarst, Fed. Rep. of Germany

[73] Assignee: Rheinmetall GmbH, Ratingen, Fed. Rep. of Germany

[21] Appl. No.: 1,717

[22] Filed: Jan. 7, 1993

[30] Foreign Application Priority Data

Jan. 7, 1992 [DE] Fed. Rep. of Germany ..... 4200171

[51] Int. Cl.[5] ..... F41A 21/18

[52] U.S. Cl. ..... 42/78; 29/1.1

[58] Field of Search ..... 42/78; 29/1.1, 1.11

[56] References Cited

U.S. PATENT DOCUMENTS

| | | | |
|---|---|---|---|
| H275 | 6/1987 | Steiner | 42/78 |
| 4,924,614 | 5/1990 | Hoffmann et al. | 42/78 |

FOREIGN PATENT DOCUMENTS

| | | | |
|---|---|---|---|
| 437675 | 7/1991 | European Pat. Off. . | |
| 307710 | 12/1919 | Fed. Rep. of Germany . | |
| 1935587 | 1/1971 | Fed. Rep. of Germany | 42/78 |
| 2140566 | 3/1973 | Fed. Rep. of Germany . | |
| 3409073 | 9/1985 | Fed. Rep. of Germany . | |
| 931140 | 2/1948 | France | 42/78 |
| 127849 | 6/1919 | United Kingdom . | |

OTHER PUBLICATIONS

Cranz, "Innere Ballistik. Die Bewegung des Geschosses durch das Rohr und Ihre Begleit Erscheinungen", 1926, pp. 340–374.

Hänert, "Geschütz und Schuss. Eine Einführung in die Geschützmechanik und Ballistik", 1940, pp. 66–77.

Bethell, H. A., Modern Guns and Gunnery, 1910, pp. 76–77.

Rheinmetall, Handbook on Weaponry, 1982, pp. 572–579.

*Primary Examiner*—Stephen C. Bentley

*Attorney, Agent, or Firm*—Spencer, Frank & Schneider

[57] ABSTRACT

The present invention relates to a gun tube having a spin curve with a variable spin angle as well as a rifling force R(x) over the path of the projectile (x) through the gun tube when a projectile is fired, as well as a predetermined caliber d, projectile mass $m_G$, mass moment of inertia J about the longitudinal axis of the projectile, gas pressure force P(x) on the projectile bottom and projectile velocity v(x). In order to realize, within the framework of manufacturing tolerances, an accurate spin curve corresponding to diverse desired characteristics of the rifling force, it is provided that the rifling force R(x) is determined according to $$R(x)=R_{max}R_n(x)$$

where $R_{max}$ is the maximum rifling force value which is a function of a predetermined final spin angle $\beta_E$ and $R_n(x)$ is a predetermined, standardized rifling force curve with a defined onset of spinning, a defined initial spin angle and a defined spin profile, with the development of the spin on the caliber diameter being determined from the following differential equation:

$$y'' = \frac{d^2 R_{max} R_n(x)}{4Jv^2(x)} - \frac{P(x)}{m_G v^2(x)} y'$$

and from $R_{max}$ for a given final spin angle $\beta_E$.

3 Claims, 7 Drawing Sheets

GUN TUBE

BACKGROUND OF THE INVENTION

The present invention relates to a gun tube having a spin curve with a variable spin angle and a rifling force R(x) over the path of the projectile that becomes effective when a projectile is fired. The gun tube further has a given caliber d, projectile mass $m_G$, a moment of mass inertia J about the longitudinal axis of the projectile, a gas pressure force P(x) on the projectile bottom, and a projectile velocity v(x).

According to the book entitled "Waffentechnisches Taschenbuch" [Handbook on Weaponry], published by Rheinmetall GmbH, Düsseldorf, 1980, gun tubes of this type are known in which various types of spin may be provided which cause different rifling force curves over the movement of spin stabilized projectiles. Constant and parabolic spin curves are employed most frequently. However, in these cases, the ideal rifling force curve is realized at most in an approximation, although the equation for the rifling force over the projectile path in the gun tube is known from this publication in a good approximation as $$R(x) = \frac{4J}{d^2 m_G}\left(\frac{dy}{dx}P(x) + \frac{d^2y}{dx^2}v^2(x)m_G\right) \quad (1)$$

where d is the caliber of the gun tube, $m_G$ is the weight of the projectile, J is the moment of inertia of the masses about the longitudinal axis of the projectile, P(x) is the force of the gas against the projectile bottom and v(x) is the velocity of the projectile.

German Patent No. 3,409,073 discloses the optimization of spin in the gun tube relative to certain characteristics by means of a polynomial, while DE-OS [Unexamined Published German Patent Application] 4,001,130 discloses the realization of the same with the aid of breaking up the spin angle into a Fourier series. Here again, no ideal rifling force curve results and correspondingly these solutions have advantages and disadvantages.

SUMMARY OF THE INVENTION

It is an object of the present invention to provide a gun tube which, within the framework of manufacturing tolerances, exhibits an accurate spin curve corresponding to diverse desired characteristics of the rifling force. This is accomplished by the invention according to which force R(x) is determined by $$R(x) = R_{max}R_n(x),$$

where $R_{max}$ is the maximum value for the rifling force, which is a function of a predetermined final spin angle $\beta_E$, and $R_n(x)$ is a predetermined, standardized rifling force curve having a defined onset of spinning, a defined initial spin angle and a defined spin profile, with the development of the spin on the caliber diameter being determined from the following differential equation:

$$y'' = \frac{d^2 R_{max} R_n(x)}{4Jv^2(x)} - \frac{P(x)}{m_G v^2(x)}y'$$

and from $R_{max}$ for a given final spin angle $\beta_E$.

Thus it becomes possible to predetermine all relevant parameters of the gun tube, namely:

- caliber d;
- gun tube length;
- projectile mass
- moment of inertia of the projectile mass j;
- internal ballistics:
  - pressure against the projectile bottom P(x);
  - velocity of the projectile v(x);
- onset of spin (starting at the rear edge of the gun tube);
- desired spin profile (geometry of rifling and lands);
- initial spin angle $\beta_A$;
- final spin angle $\beta_E$.

In addition, a standardized rifling force curve $R_n(x)$ is given which qualitatively describes the desired rifling force for every position of the projectile. The standardized rifling force $R_n(x)$ is determined according to the following aspects:

- reduction of the maximum rifling force by a capacious rifling force curve in order to reduce:
  - stress on the rotating bands;
  - stress on the gun tube (wear, fatigue);
  - spin moment (gun tube vibrations/absorption of spin);
  - reduction of rifling force at the muzzle (intermediate ballistics);
  - reduction of changes in spin angle during passage of the projectile in order to prevent excessive deformations of the rotating band.

BRIEF DESCRIPTION OF THE DRAWINGS

The above and other features of the invention will become apparent from the following detailed description taken with the drawings in which.

DETAILED DESCRIPTION OF THE PREFERRED EMBODIMENT

Figure 1:
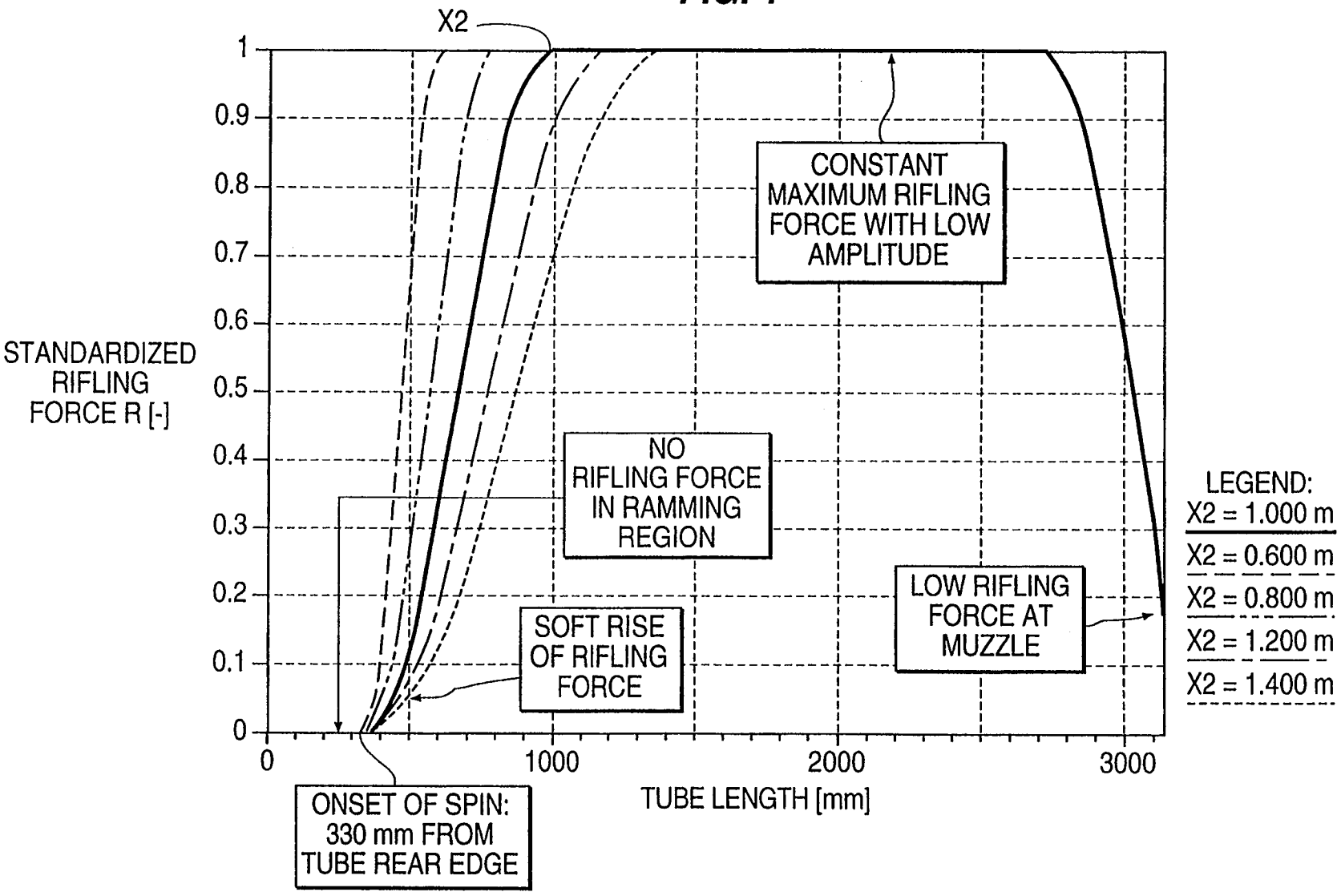
FIG. 1 shows standardized rifling force plotted versus tube length.

For the gun tube of a 35 mm automatic cannon, the standardized rifling force curve $R_n(x)$ shown in FIG. 1 (solid line), plotted over the tube length x meets the stated requirements in an ideal manner. The constant rifling force which begins at a gun tube length value of $x_2$ results in a capacious rifling force curve and a low spin moment. No rifling force acts in the ramming region and the rifling force rises gently with the onset of spin so that the gun tube experiences low wear and stresses on the rotating band are low. Only a low rifling force acts on the gun muzzle as well so that improved intermediate ballistics are realized.

In connection with automatic cannons, a reduced change in the spin angle, which is intended to limit the deformation work of the rotating band of the projectile, is usually not important. Rather, an initial spin angle $\beta_A=0°$ and a gentle rise are desirable so that the gun tube, the rotating band and the ignition component are stressed as little as possible.

Greater stresses are acceptable for artillery equipment, but it is more important to have smaller changes in spin angle during the entire passage of the projectile (initial spin angle $\beta_A$ as great as possible).

Correspondingly other rifling force curves than the solid line in FIG. 1 can be used as a basis, for example, depending on the particular application, the curves drawn in dashed or dash-dot lines.

The actually desired rifling force curve R(x) results as follows from the standardized rifling force $R_n(x)$:

$$R(x)=R_{max}R_n(x) \tag{2}$$

where $R_{max}$ is a maximum rifling force value which must still be determined and which is a function, among others, primarily of the final spin angle $\beta_E$.

If y(x) is the development of spin on the caliber diameter, the following applies:

$$\beta = \text{atan}\left(\frac{dy}{dx}\right)\text{spin angle}$$

$$y' = \frac{dy}{dx} = \tan\beta$$

$$y'' = \frac{d^2y}{dx^2} = \frac{d\beta}{dx}\ \frac{1}{\cos^2(x)}\ y'$$

Thus, under consideration of the above mentioned known Equation (1) for the rifling force, which describes it in a good approximation, the following differential equation can be derived:

$$y'' = \frac{d^2R_{max}R_n(x)}{4Jv^2(x)} - \frac{P(x)}{m_Gv^2(x)}\ y' \tag{3}$$

Figure 2:
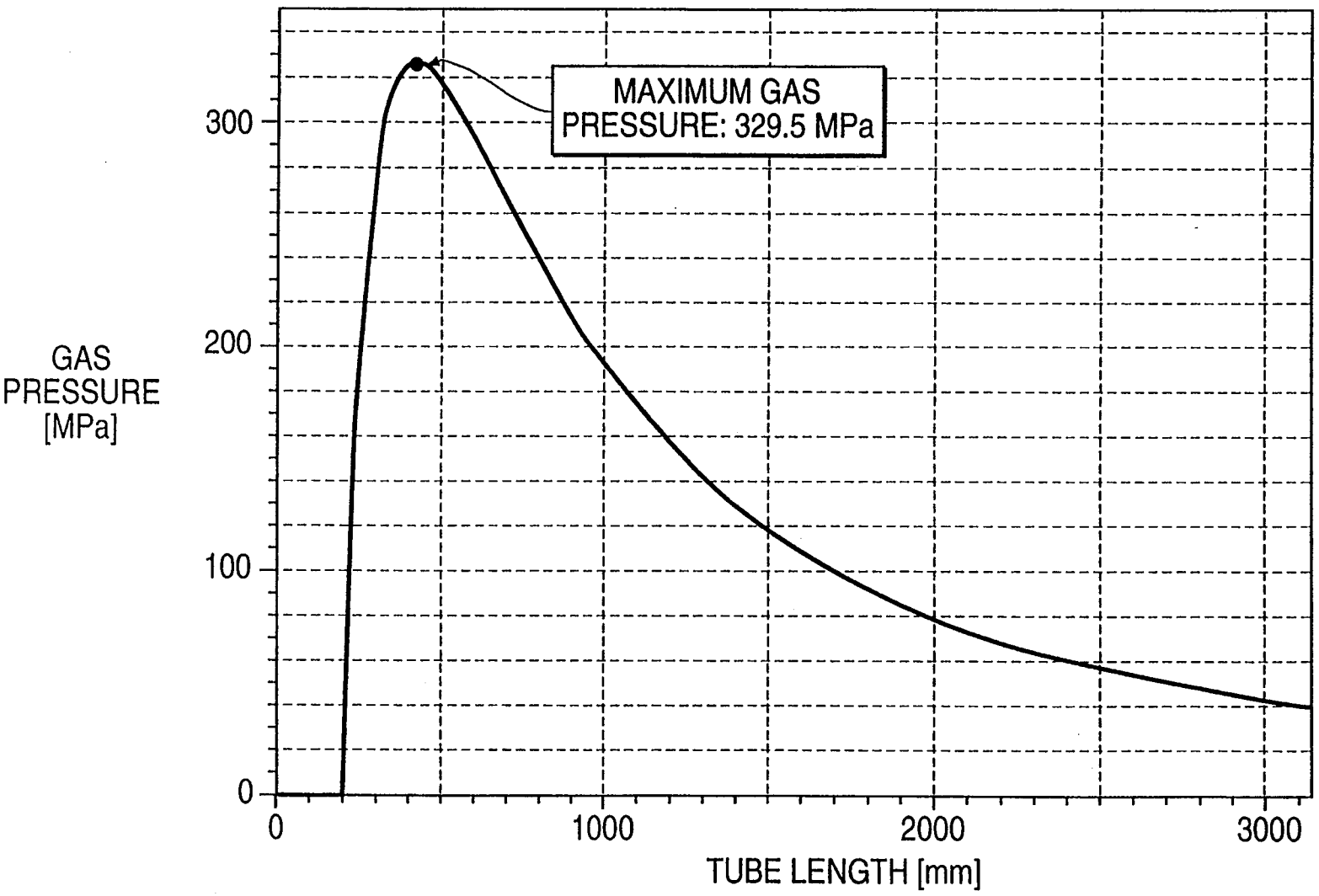
FIG. 2 show gas pressure against a projectile bottom plotted versus tube length.
Figure 3:
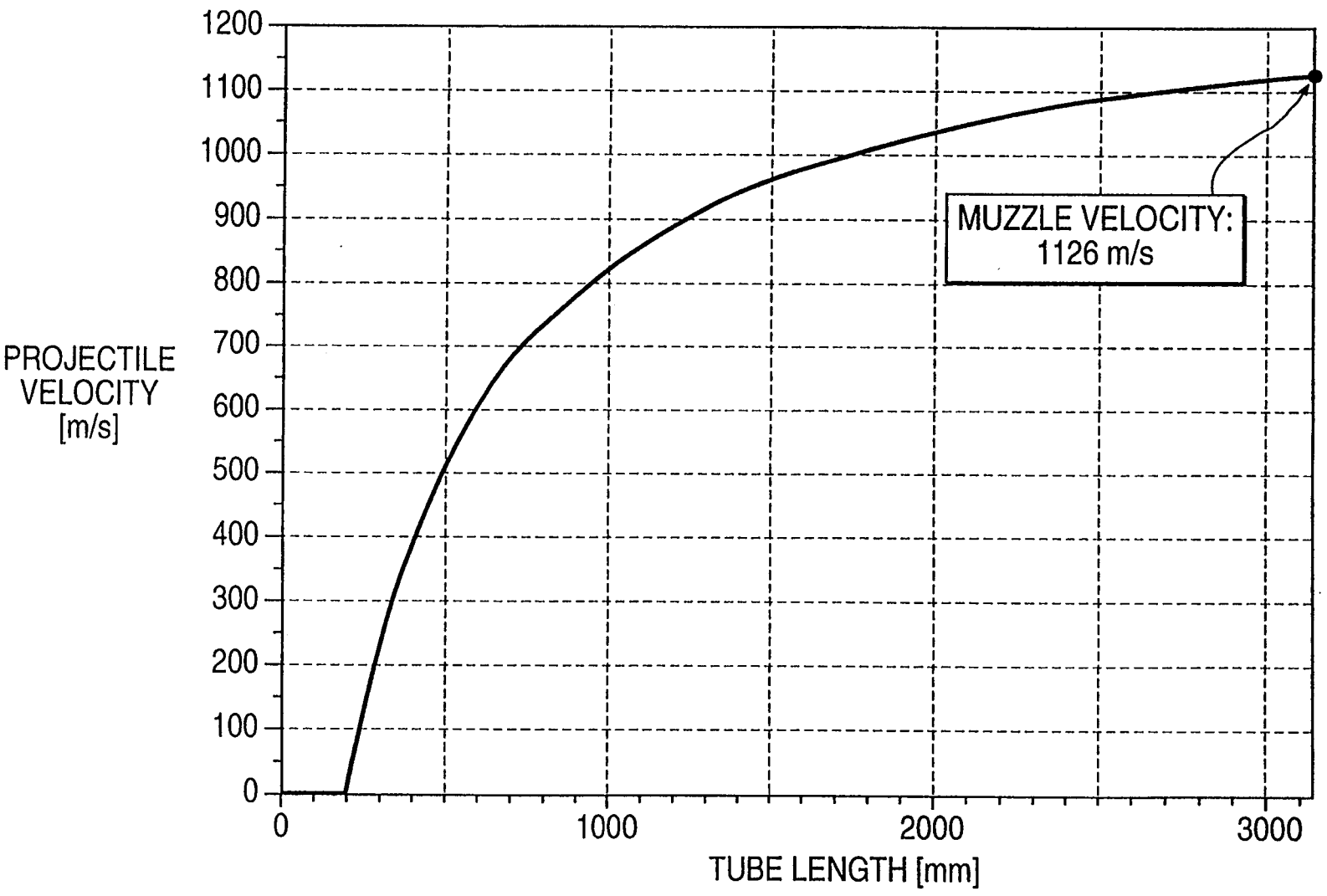
FIG. 3 shows projectile velocity plotted as a function of tube length.

With the solution of this differential Equation (3), assuming $R_{max}=1$ N and based on a predetermined projectile bottom pressure and a predetermined projectile velocity as a function of the gun tube length x, as shown in FIGS. 2 and 3, one obtains an arbitrary final spin angle $\beta_E$ which generally does not coincide with the predetermined value. By varying $R_{max}$ and possibly performing an extrapolation or interpolation, one then obtains the precise solution y(x) for the predetermined final spin angle $\beta_E$ according to which the spin theorem can be fashioned that meets all requirements placed on the rifling force.

Figure 4:
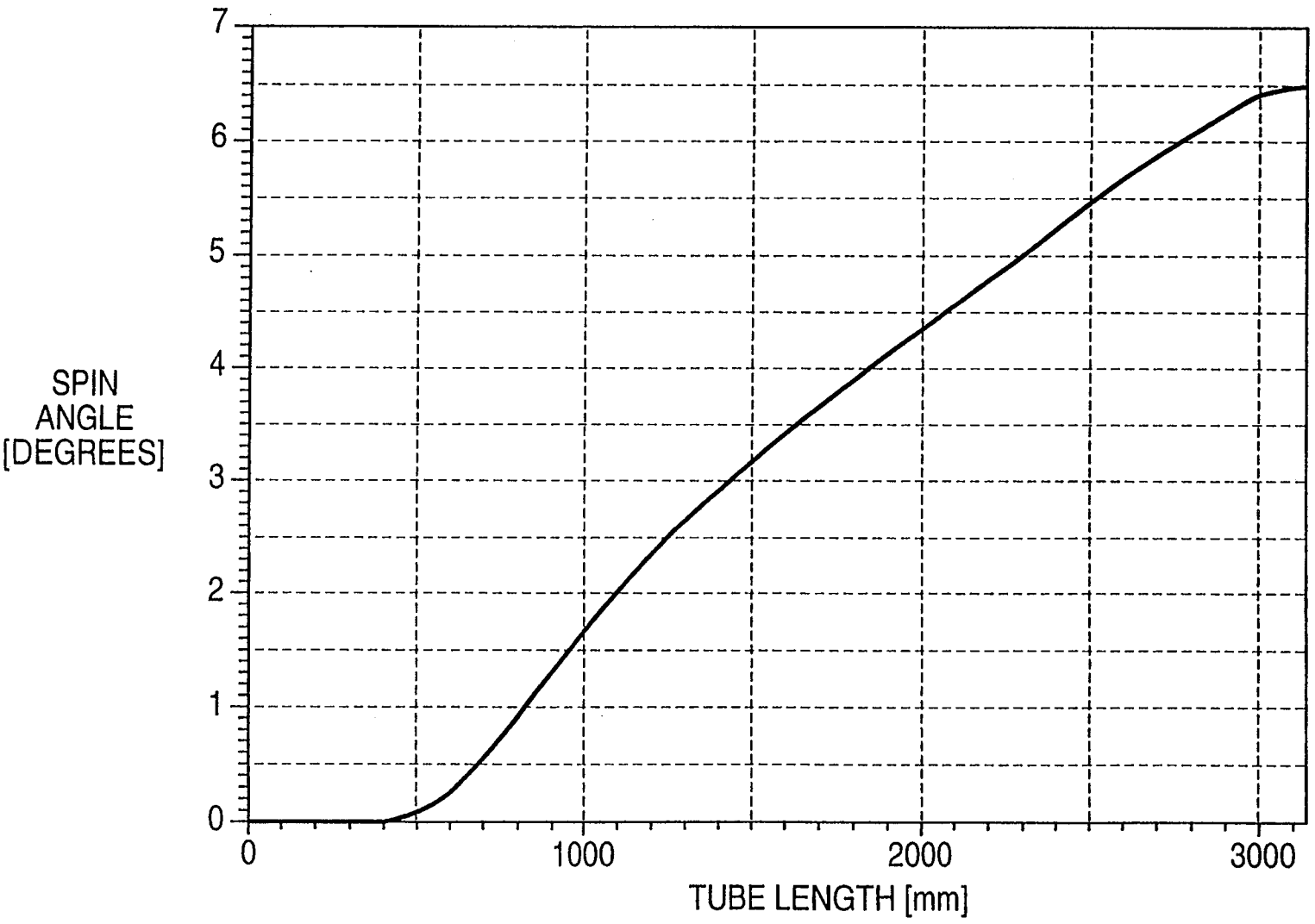
FIG. 4 is a plot of optimized spin angle over the tube length.
Figure 5:
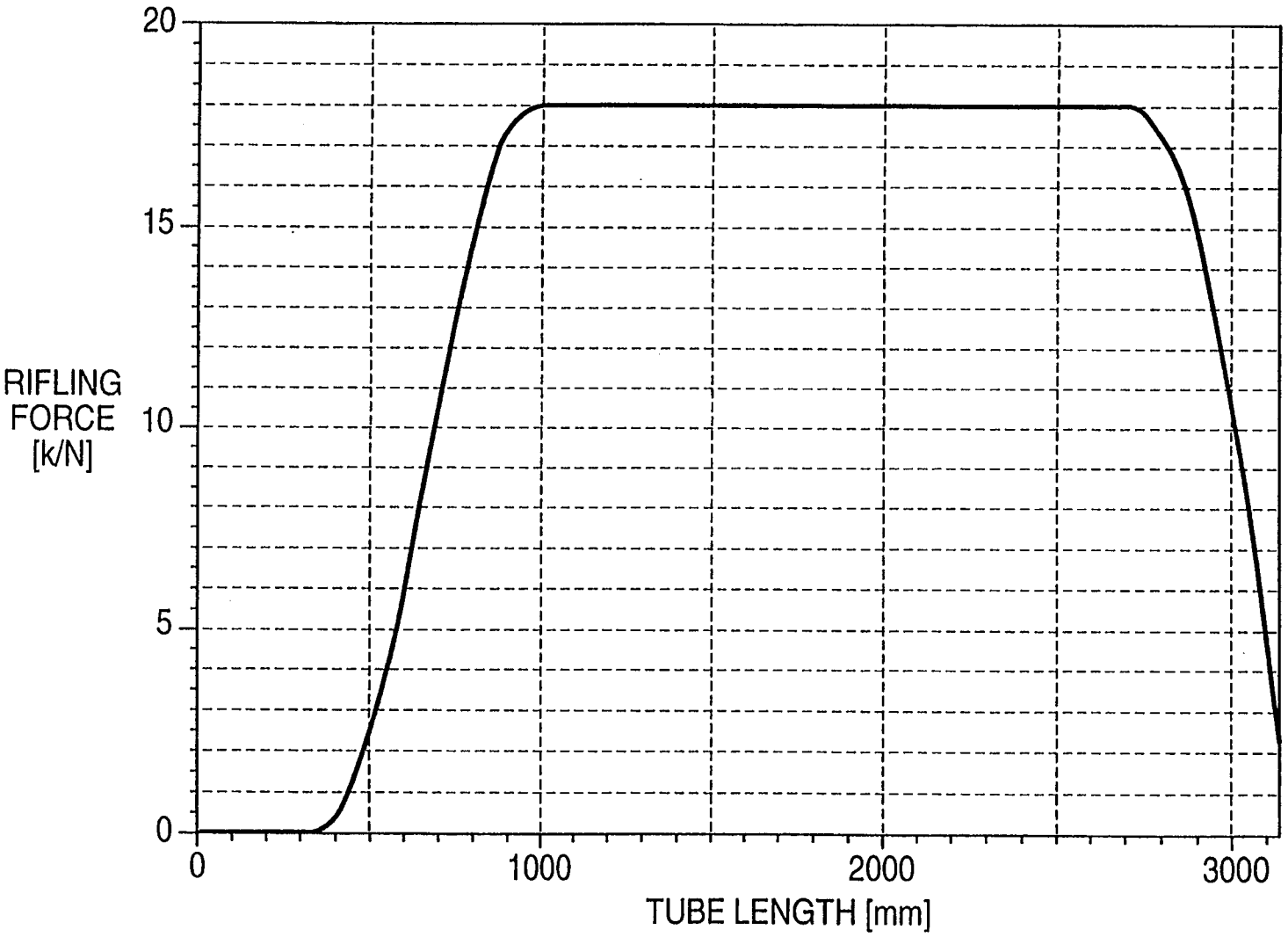
FIG. 5 is a plot of the rifling force over the tube length.
Figure 6:
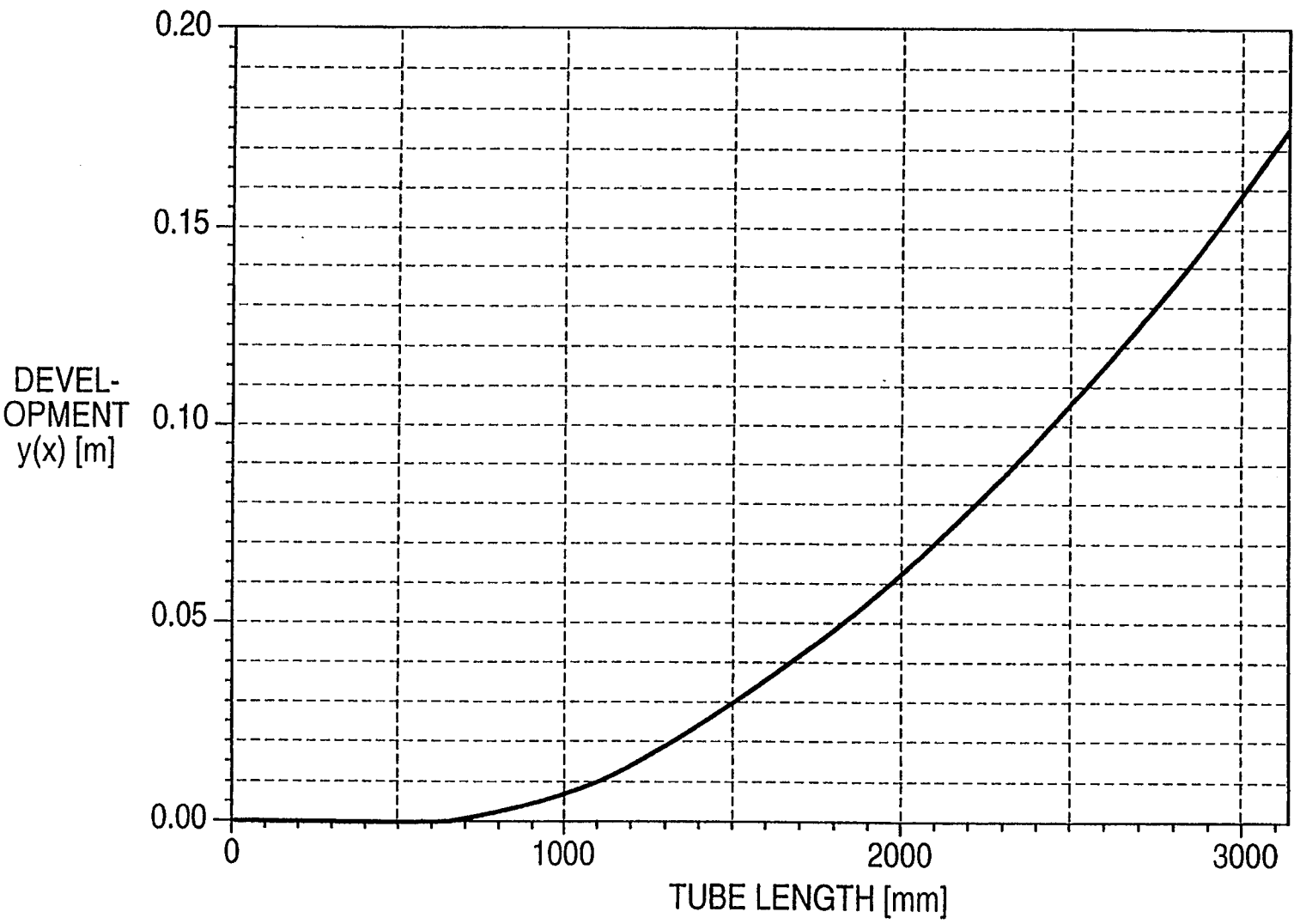
FIG. 6 is a plot of the development of y(x) over the tube length.
Figure 7:
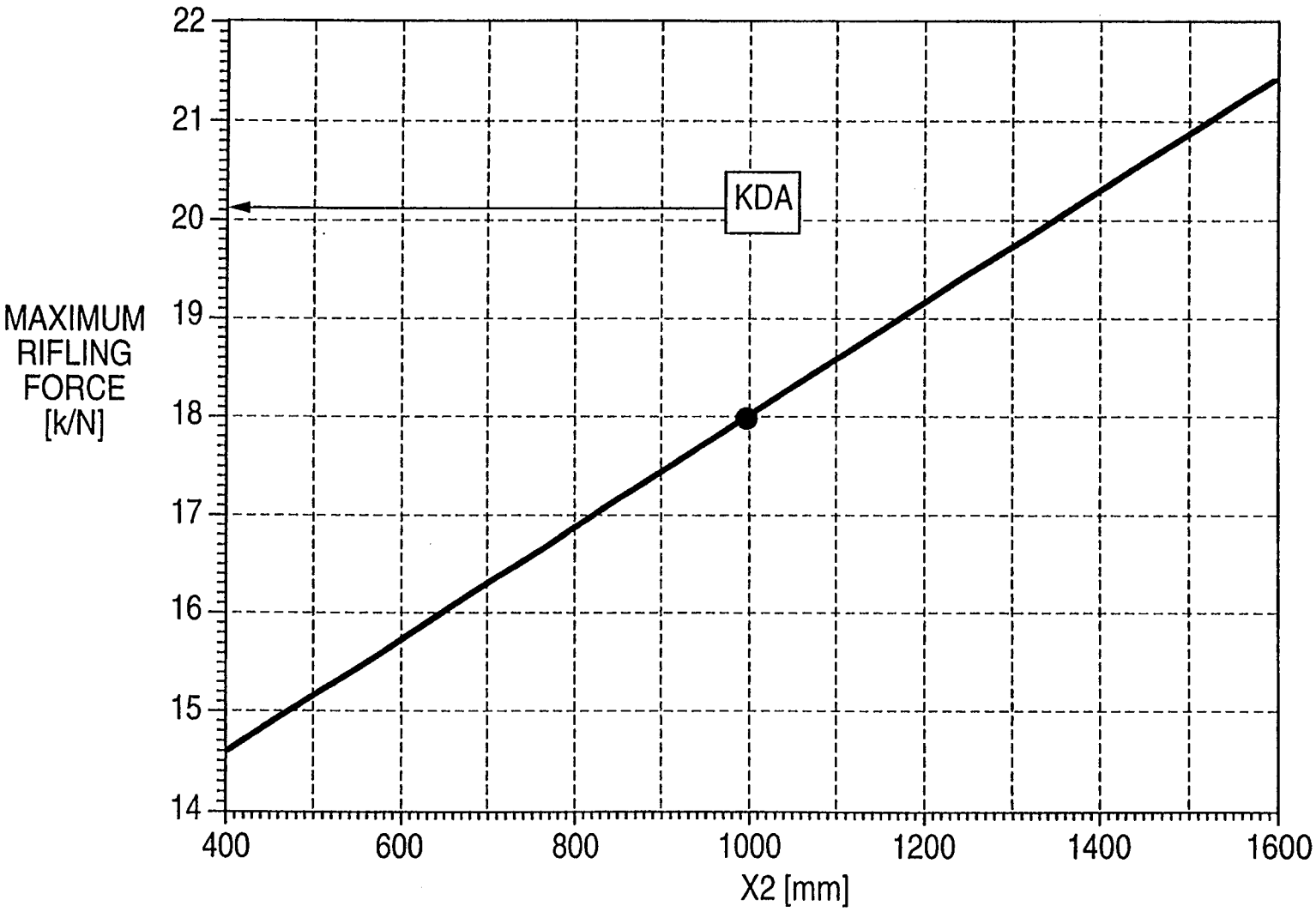
FIG. 7 is a plot of the maximum rifling force as a function of the standardized rifling force used as a basis.

Thus, in the case of the mentioned example of the spin configuration for a 35 mm automatic cannon tube, a spin angle curve y(x) results as shown in FIG. 4. This spin angle, together with the geometrical and internal ballistic conditions of the automatic cannon, results in a rifling force curve as shown in FIG. 5 which has a maximum value $R_{max}=17{,}981.111$ N. For the manufacture of the spin profile according to the calculated spin theorem, the development of y(x) over the tube length as shown in FIG. 6 is required. FIG. 7 shows the maximum rifling force for this case as a function of the standardized rifling force curve used as a basis. Compared to a conventional weapon (KDA) which has a parabolic spin and in which, moreover, various measures have been taken to reduce stresses, vibrations and jump angle, the resulting rifling force is reduced by about 15%.

It will be understood that the above description of the present invention is susceptible to various modifications, changes and adaptations, and the same are intended to be comprehended within the meaning and range of equivalents of the appended claims.

What is claimed is:

1. A gun tube having a spin curve with a variable spin angle and a rifling force R(x) over the path of the projectile (x) within the gun tube that becomes effective when a projectile is fired, as well as a given caliber d, projectile mass $m_G$, moment of mass inertia J about the longitudinal axis of the projectile, gas pressure force P(x) on the projectile bottom, and projectile velocity v(x), the improvement wherein the rifling force R(x) is determined according to $$R(x)=R_{max}R_n(x),$$

where $R_{max}$ is the maximum value for the rifling force, which is a function of a predetermined final spin angle $\beta_E$, and $R_n(x)$ is a predetermined, standardized rifling force curve having a defined onset of spinning, a defined initial spin angle and a defined spin profile, with the development of the spin on the caliber diameter being determined from the following differential equation:

$$y'' = \frac{d^2R_{max}R_n(x)}{4Jv^2(x)} - \frac{P(x)}{m_Gv^2(x)}\ y'$$

and from $R_{max}$ for a given final spin angle $\beta_E$;

wherein the precise solution for y(x) for the given final spin angle $\beta_E$ is determined from the solution of the differential equation for a predetermined value of $R_{max}$ by way of varying $R_{max}$ and by extrapolation or interpolation.

2. A gun barrel comprising:

a rifled bore defining a projectile displacement path (x) and having a rifling twist with a spin angle curve $\beta(x)$ for imparting a rifling force R(x) to the projectile over the displacement path (x) of the projectile within the bore, there being defined a given caliber d, projectile mass $m_G$, moment of mass inertia J about the longitudinal axis of the projectile, gas pressure force P(x) on the projectile bottom, and projectile velocity v(x), wherein the rifling force R(x) is determined according to $$R(x)=R_{max}R_n(x),$$

where $R_{max}$ is the maximum value for the rifling force, which is a function of a predetermined final spin angle $\beta_E$, and $R_n(x)$ is a predetermined, standardized rifling force curve having a defined onset of spinning, a defined initial spin angle and a defined spin profile, with the development of the spin on the caliber diameter being determined from the following differential equation:

$$y'' = \frac{d^2R_{max}R_n(x)}{4Jv^2(x)} - \frac{P(x)}{m_Gv^2(x)}\ y'$$

and from $R_{max}$ for a given final spin angle $\beta_E$; and wherein the precise solution for y(x) for the given final spin angle $\beta_E$ is determined from the solution of the differential equation for a predetermined value of $R_{max}$ by way of varying $R_{max}$ and by extrapolation or interpolation.

3. A method of manufacturing a gun barrel with an accurate spin curve corresponding to diverse desired characteristics of a rifling force, comprising:

providing a rifled bore defining a projectile displacement path () and having a rifling twist with a spin angle curve $\beta(x)$ for imparting a rifling force R(x) to the projectile over the displacement path (x) of the projectile within the bore, there being defined a given caliber d, projectile mass $m_G$, moment of mass inertia J about the longitudinal axis of the projectile, gas pressure force P(x) on the projectile bottom, and projectile velocity v(x), wherein the rifling twist of the rifled bore is provided by determining the rifling force R(x) according to $$R(x)=R_{max}R_n(x),$$

where $R_{max}$ is the maximum value for the rifling force, which is a function of a predetermined final spin angle $\beta_E$, and $R_n(x)$ is a predetermined, standardized rifling force curve having a defined onset of spinning, a defined initial spin angle and a defined spin profile;

wherein the development of the spin on the caliber diameter being determined from the following differential equation:

$$y'' = \frac{d^2R_{max}R_n(x)}{4Jv^2(x)} - \frac{P(x)}{m_Gv^2(x)}y'$$

and from $R_{max}$ for a given final spin angle $\beta_E$; and wherein the precise solution for y(x) for the given final spin angle $\beta_E$ is determined from the solution of the differential equation for a predetermined value of $R_{max}$ by way of varying $R_{max}$ and by extrapolation or interpolation.

* * * * *